US007534003B2

(12) United States Patent
Tamborini

(10) Patent No.: US 7,534,003 B2
(45) Date of Patent: May 19, 2009

(54) LIGHTING DEVICE FOR OUTDOOR USE

(75) Inventor: Ariberto Tamborini, Daverio (IT)

(73) Assignee: Merlett Tecnoplastic S.p.A., Daverio (Varese) (IT)

( * ) Notice: Subject to any disclaimer, the term of this patent is extended or adjusted under 35 U.S.C. 154(b) by 174 days.

(21) Appl. No.: 11/521,948

(22) Filed: Sep. 15, 2006

(65) Prior Publication Data

US 2007/0253184 A1 Nov. 1, 2007

(30) Foreign Application Priority Data

Apr. 28, 2006 (IT) ..... MI20060154 U

(51) Int. Cl.
*F21V 9/16* (2006.01)

(52) U.S. Cl. ..... 362/84

(58) Field of Classification Search ..... 362/227, 362/151, 152, 183, 84, 34, 253, 145, 153
See application file for complete search history.

(56) References Cited

U.S. PATENT DOCUMENTS

| | | | | |
|---|---|---|---|---|
| 7,216,999 | B2 * | 5/2007 | Kaplan et al. | 362/34 |
| 2002/0003697 | A1 * | 1/2002 | Chien | 362/84 |
| 2004/0201992 | A1 * | 10/2004 | Dalton et al. | 362/276 |

* cited by examiner

*Primary Examiner*—Bao Q Truong
(74) *Attorney, Agent, or Firm*—James V. Costigan; Hedman & Costigan, P.C.

(57) ABSTRACT

An improved lighting device for outdoor use comprises a tubular lamp body, made of a polymeric material or other synthetic resin, encompassed by an integrally extruded spiral member in which is co-extruded a luminescent and/or phosphorescent material.

3 Claims, 1 Drawing Sheet

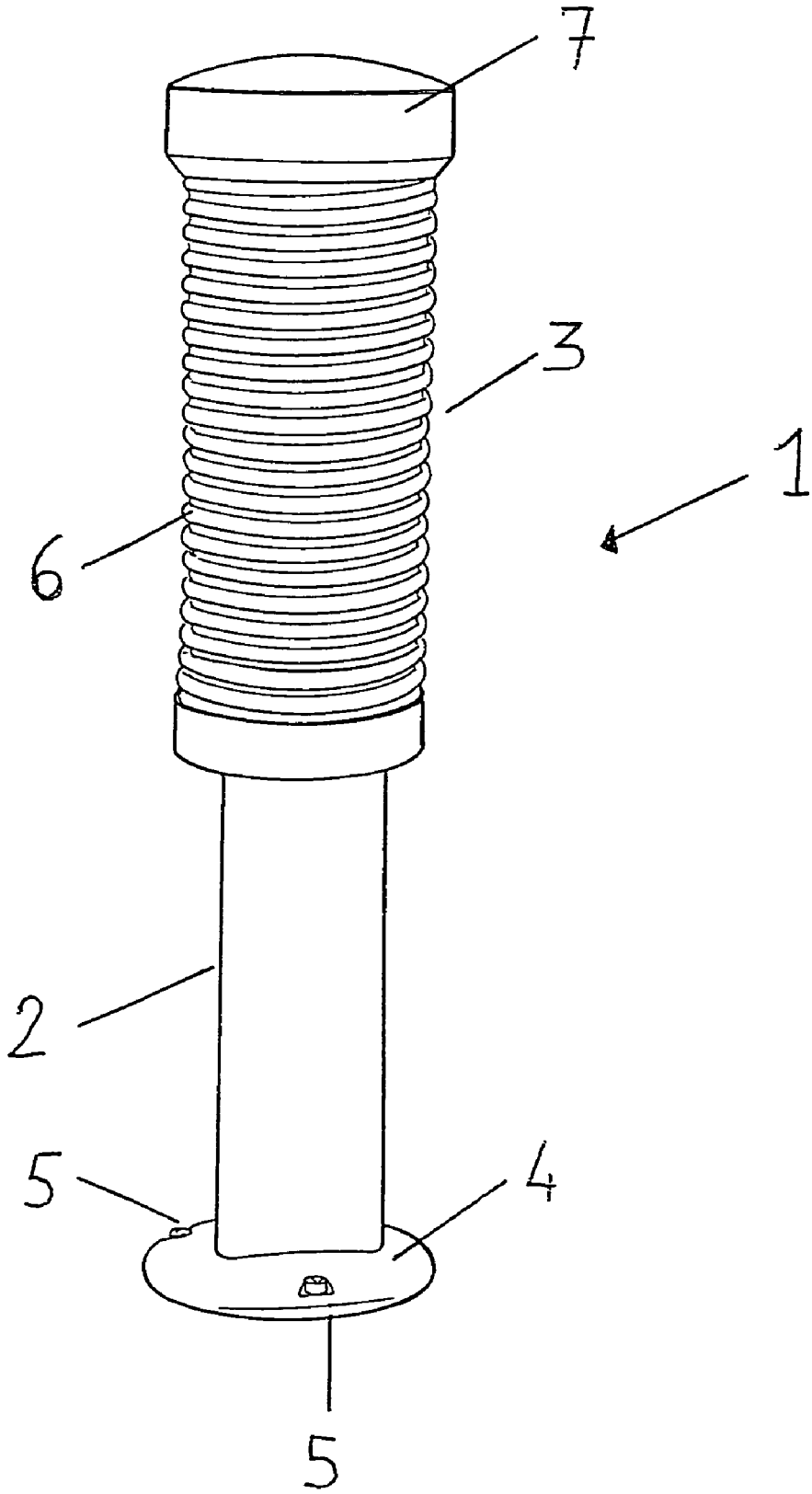
7
3
1
6
2
5
4
5

LIGHTING DEVICE FOR OUTDOOR USE

BACKGROUND OF THE INVENTION

The present invention relates to an improved lighting device, specifically designed for outdoor applications, and having improved operating characteristics.

As is known, lamps or illuminating devices in general used in outdoor applications, must be very strong, reliable in operation, and resistant against water and dirt; moreover, they must have a pleasant aesthetic aspect.

Prior outdoor illuminating devices provide to use lamps or Chinese lanterns made of polymeric materials, adapted to meet the above mentioned operating requirements, with a comparatively low making cost.

SUMMARY OF THE INVENTION

The aim of the present invention is to provide an improved lighting device, specifically but not exclusively adapted to be used in outdoor applications, which has improved operating and functional characteristics with respect to like prior lighting devices.

Within the scope of the above mentioned aim, a main object of the invention is to provide such a lighting device which can be easily made by using commercially available materials and elements.

Yet another object of the invention is to provide such a lighting device which is very inexpensive and has very good aesthetic characteristics.

According to one aspect of the present invention, the above mentioned aim and objects, as well as yet other objects, which will become more apparent hereinafter, are achieved by a lighting device, for outdoor uses, as herein claimed.

BRIEF DESCRIPTION OF THE DRAWING

Further characteristics and advantages of the present invention will become more apparent hereinafter from the following detailed disclosure of a preferred, though not exclusive, embodiment of the invention, which is illustrated, by way of an indicative, but not limitative example, in the accompanying drawing, the sole FIGURE of which is a perspective view of the subject lamp or lighting device construction which has been improved according to the invention.

DESCRIPTION OF THE PREFERRED EMBODIMENT

With reference to the number references of the above mentioned FIGURE, the lighting device or lamp construction according to the invention, which has been generally indicated by the reference number 1, comprises a supporting element 2, adapted to support a lamp body 3 and including a bearing base or bottom 4.

Said bearing base or bottom 4 may comprise clamping means for clamping the lighting device to a floor or the ground, said clamping means comprising, for example, a plurality of clamping bolts 5.

According to the invention, the tubular lamp body 3 is substantially constituted by a tube 3 encompassed by a coil or spiral member 6.

In particular, the tube 3 is preferably, though not exclusively, made of a plasticized polyvinylchloride (PVC) material, whereas the spiral or coil member 6 can be made of a thermoplastic polymer, such as a rigid PVC.

Said tube may be coated on its outside by an anti-abrasion coating layer, made of a polyurethane or other plastics material of like characteristics, and it can be lined in its inside by a like lining layer which, advantageously, can be further coated by a disposable layer, which would be very useful for facilitating the making of the device by known prior making means.

According to an important aspect of the invention, the light emitting or phosphorescent material is not, co-extruded with the spiral or coil member 6.

In particular, said light emitting or phosphorescent material can be provided, for example, in a film form, or as a thermoplastic polymeric material co-extruded with the spiral member 6.

Thus, the tube can be made by hot extruding a strip member which, as encompassed on a pulling mandrel, will form, at the end of a cooling step, the desired tube.

The extruding is performed by an extruding head, of a per se known type, supplied by a plurality of extruders, each of which will form that portion of the strip contributing to making one of the tube elements or members.

Finally, the pulling mandrel, by a plurality of rollers, will adjust the inclination of the strip, so as to cause the strip turns to be fed along said mandrel, thereby they are sealed onto one another to form the desired tube.

Thus, the formed tube will be ready for use, at the end of the winding and cooling operating steps.

As shown, the lamp body 3 is closed, and the top thereof, by a cover member 7, preventing water and dirt from entering the lamp body.

in fact, the inventive device provides a post-switching off illuminating effect which can be used both for an ornamental purpose or for a functional one.

The invention claimed is:

1. Lighting device for outdoor applications, said lighting device comprising a lamp body tube made of polymeric or other synthetic resin materials and having an outer surface encompassed by an extruded spiral member, wherein a luminescent or phosphorescent material is co-extruded with said extruded spiral member, and wherein said lighting device further comprises a supporting element adapted to support said lamp body and including a bearing bottom comprising clamping bolts for clamping said bearing bottom to a floor.

2. The lighting device, according to claim 1, wherein said lamp body tube is made of a plasticized polyvinylchloride and said spiral member is made of rigid polyvinylchloride.

3. The lighting device, according to claim 1, wherein said luminescent or phosphorescent material is co-extruded as a film on said spiral member.

* * * * *